US008863644B2

(12) United States Patent
Fujiwara

(10) Patent No.: US 8,863,644 B2
(45) Date of Patent: Oct. 21, 2014

(54) CAM MECHANISM AND LIQUID SENDING PUMP HAVING SAME

(75) Inventor: Masanori Fujiwara, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 808 days.

(21) Appl. No.: 13/016,479

(22) Filed: Jan. 28, 2011

(65) Prior Publication Data

US 2011/0192277 A1 Aug. 11, 2011

(30) Foreign Application Priority Data

Feb. 8, 2010 (JP) ..... 2010-024963

(51) Int. Cl.
*F04B 9/04* (2006.01)
*F04B 53/18* (2006.01)

(52) U.S. Cl.
CPC ..... *F04B 53/18* (2013.01); *F04B 9/042* (2013.01)
USPC ..... 92/72; 92/153; 417/273

(58) Field of Classification Search
USPC ..... 92/72, 158, 153, 159; 184/37, 10, 18, 184/19, 20, 102, 120; 74/567; 384/136, 384/137, 392, 393; 417/273
See application file for complete search history.

(56) References Cited

U.S. PATENT DOCUMENTS

| | | | | | |
|---|---|---|---|---|---|
| 128,212 | A | * | 6/1872 | Utzat et al. | 301/83 |
| 263,751 | A | * | 9/1882 | Baldridge | 384/137 |
| 747,900 | A | * | 12/1903 | Warner | 74/586 |
| 762,565 | A | * | 6/1904 | Warner | 184/102 |
| 1,143,307 | A | * | 6/1915 | Noyes | 184/11.1 |
| 1,156,323 | A | * | 10/1915 | Shearer | 451/239 |
| 1,523,523 | A | * | 1/1925 | Guetl | 384/137 |
| 1,686,271 | A | * | 10/1928 | George et al. | 184/11.1 |
| 1,710,121 | A | * | 4/1929 | Smith | 184/11.2 |
| 2,007,217 | A | * | 7/1935 | Rose | 184/102 |
| 2,265,047 | A | * | 12/1941 | Tognola | 184/102 |
| 2,409,874 | A | * | 10/1946 | Lessmann | 384/136 |
| 2,425,744 | A | * | 8/1947 | Fritz | 184/102 |
| 3,138,222 | A | * | 6/1964 | Dames et al. | 184/11.2 |
| 3,294,457 | A | * | 12/1966 | Johnson | 384/404 |
| 3,628,425 | A | * | 12/1971 | Morita et al. | 91/491 |
| 5,601,155 | A | * | 2/1997 | Gardner | 184/11.2 |
| 5,810,116 | A | * | 9/1998 | Kaptrosky | 184/11.1 |
| 2005/0214139 | A1 | | 9/2005 | Aso | |

FOREIGN PATENT DOCUMENTS

| | | | |
|---|---|---|---|
| CN | 1673735 | A | 9/2005 |
| CN | 201320479 | Y | 10/2009 |
| JP | 7-318548 | A | 12/1995 |
| JP | 2005-111609 | A | 4/2005 |

OTHER PUBLICATIONS

The First Office Action for the Application No. 201110037860.9 from The State Intellectual Property Office of The People's Republic of China dated Apr. 9, 2013.

* cited by examiner

*Primary Examiner* — Thomas E Lazo
(74) *Attorney, Agent, or Firm* — Cheng Law Group, PLLC

(57) ABSTRACT

A lubricant supply mechanism is provided to an upper portion of a cam. A fixing member of the lubricant supply mechanism includes a recovery blade as a lubricant recovery member having lower end portions in contact with side face peripheral edge portions of the cam. The lower end portions of the recovery blade are in contact with the side face peripheral edge portions of the cam. An angle θ, which the lower end portions of the recovery blade make with a direction of rotation of the cam is smaller than 90°.

4 Claims, 5 Drawing Sheets

CAM MECHANISM AND LIQUID SENDING PUMP HAVING SAME

BACKGROUND OF THE INVENTION

1. Field of the Invention

The present invention relates to a cam mechanism for operating plungers of a plunger pump and a liquid sending pump having the cam mechanism. Particularly, the cam mechanism relates to one having a lubricant supply mechanism for supplying lubricant to contact portions between cams and cam followers.

2. Description of the Related Art

As a liquid sending pump used for sending a solution such as mobile phase in liquid chromatograph, there is a pump formed to convert rotary movement of a motor into reciprocating movement in a certain direction by a cam mechanism to drive plungers (see Japanese Patent Application Laid-Open No. 7-318548, for example). Base end portions of the plungers are retained by cam followers and the cam followers are displaced following peripheral faces of the cams to thereby reciprocate the plungers in a certain direction. When tip ends of the plungers are inserted into pump chambers in pump heads and slide, the solution is taken into the pump chambers and discharged from the pump chambers.

In such a liquid sending pump, mechanisms for supplying lubricant to contact portions between the cams and the cam followers are provided in order to minimize a load on the motor so that rotation of the motor is controlled with high accuracy. A common lubricant supply mechanism is one formed to apply the lubricant on the peripheral face of the cam by retaining a sponge impregnated with the lubricant in a position in contact with the peripheral face of the cam.

However, part of the lubricant applied on the peripheral face of the cam is pushed out of the contact portion between the cam and the cam follower, flows to side faces of the cam, and is wasted without utilized as the lubricant. In prior art, the lubricant flowing to the side faces of the cam cannot be utilized and some of the lubricant impregnated into the sponge of the lubricant supply mechanism is wasted.

SUMMARY OF THE INVENTION

It is therefore an object of the present invention to improve use efficiency of lubricant supplied to contact portions between cams and cam followers.

A cam mechanism according to the invention includes: a cam which has a peripheral face supplied with lubricant and a pair of parallel side faces sandwiching the peripheral face and which is driven for rotation; a cam follower in contact with the peripheral face and following displacement of the peripheral face due to the rotation of the cam; and a lubricant recovery member in contact with the opposite side faces of the cam, having such a length as to reach at least cam side face peripheral edge portions, which are boundaries between the side faces and the peripheral face, and disposed at an inclination angle smaller than 90° with respect to a direction of rotation of the cam.

Here, "the direction of rotation of the cam" means a direction of movement of tangency points of the cam side faces with the lubricant recovery member. FIGS. 3A and 3B show a relationship between an inclination angle of the lubricant recovery member 26 with respect to the direction of rotation of the cam and a direction of movement of the lubricant 30 recovered by the lubricant recovery member 26. As shown in FIG. 3A, if an angle θ between the lubricant recovery member 26 and the direction of rotation of the cam 19 is smaller than 90°, force toward the peripheral face along the lubricant recovery member 26 acts on the lubricant 30 held back by the lubricant recovery member 26 due to the rotation of the cam 19. As a result, the lubricant 30 held back by the lubricant recovery member 26 is guided toward the peripheral face. On the other hand, as shown in FIG. 3B, if the angle θ between the lubricant recovery member 26 and the direction of rotation of the cam 19 is larger than 90°, force toward an opposite side from the peripheral face along the lubricant recovery member 26 acts on the lubricant 30 held back by the lubricant recovery member 26 due to the rotation of the cam 19, and it is impossible to guide the lubricant 30 toward the peripheral face. Because the lubricant recovery member 26 is inclined at the angle smaller than 90° with respect to the direction of rotation of the cam 19 in the invention, the lubricant 30 on the cam side faces can be recovered and guided toward the peripheral face.

As described above, because the cam mechanism according to the invention includes the lubricant recovery member disposed at the inclination angle smaller than 90° with respect to the direction of rotation of the cam, the lubricant on the side faces of the cam is recovered and guided again to the peripheral face, and it is possible to utilize the lubricant which has flowed to the cam side faces and which could not be utilized in the prior art. In this way, it is possible to improve the use efficiency of the lubricant.

It is preferable to further include a lubricant retaining member in contact with the peripheral face of the cam and for retaining the lubricant. In this case, by retaining the lubricant in the lubricant retaining member, it is possible to constantly apply the lubricant on the peripheral face of the cam.

A liquid sending pump according to the invention is formed so that a plunger is retained by a cam follower, which is displaced following a peripheral face of a cam, the plunger is reciprocated on a straight line by rotating the cam, and a solution is taken into and discharged out of a pump chamber in which a tip end of the plunger is inserted. As a cam mechanism including a cam and a cam follower, the cam mechanism according to the invention is used.

BRIEF DESCRIPTION OF THE DRAWINGS

FIGS. 3A and 3B are conceptual diagrams for explaining a relationship between an angle, which a lubricant recovery portion and a direction of rotation of a cam form with each other, and a direction of movement of lubricant held back by the lubricant recovery portion, in which FIG. 3A shows a case of $0° < \theta < 90°$ and FIG. 3B shows a case of $90° < \theta$.

DETAILED DESCRIPTION OF THE INVENTION

Figure 1:
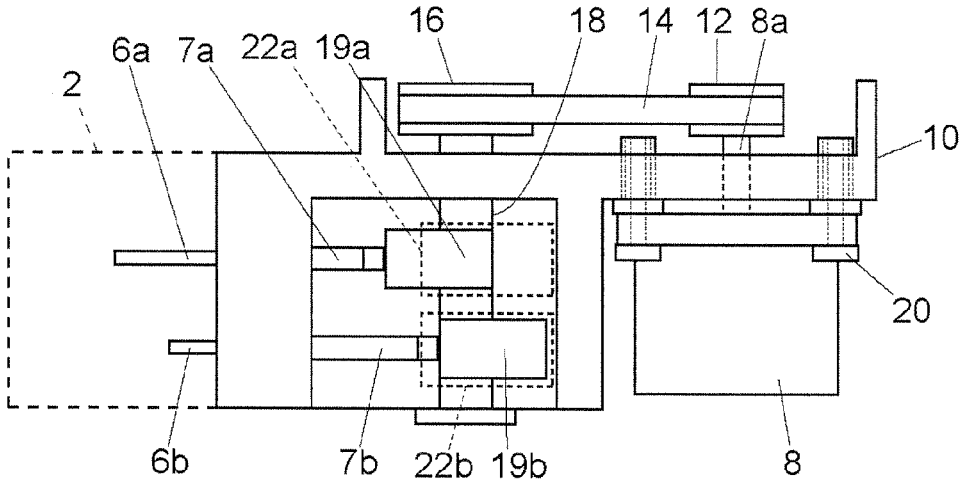
FIG. 1 is a schematic top view of an embodiment of an internal structure of a liquid sending pump.

An embodiment will be described with reference to FIGS. 1 and 2.

The liquid sending pump includes a pump head 2 and a driving portion. FIG. 1 shows an internal structure of the driving portion and a concrete example of the pump head 2 will be described later by using FIGS. 4 and 5. Although an internal structure of the pump head 2 is not shown in FIG. 1, the pump head 2 has two pump heads connected in series as an example. Pump chambers in the respective pump heads are provided with flow paths, which serve as solution inlets and solution outlets. Plungers 6*a* and 6*b* are inserted into the pump chambers in the respective pump heads from their tip end sides. When the tip end portions of the plungers 6*a* and 6*b* slide in the pump chambers, a solution is taken in and discharged at different times in the respective pump chambers to continuously send the solution.

The pump head 2 may include two pump heads connected in parallel or only one pump head.

Base end portions of the plungers 6*a* and 6*b* are respectively retained by cam followers 7*a* and 7*b*, which are also called cross heads. The cam followers 7*a* and 7*b* are retained by a retaining member 10 in such states as to be able to reciprocate on straight lines. The cam followers 7*a* and 7*b* are biased by elastic members (not shown) to an opposite side from the pump head 2 and base end portions of the cam followers 7*a* and 7*b* are respectively pushed against peripheral faces of cams 19*a* and 19*b*.

A motor 8 for driving the cams 19*a* and 19*b* is fixed to the retaining member 10 by bolts 20. A rotary shaft 8*a* of the motor 8 passes through a through hole formed in the retaining member 10 and a pulley 12 is attached to a tip end of the rotary shaft 8*a*. The pulley 12 is connected to a pulley 16 attached to one end of a driving shaft 18 by a belt 14. Both of the cams 19*a* and 19*b* are mounted to the driving shaft 18 and rotate as the driving shaft 18 rotates.

In other words, the rotary shaft 8*a* is rotated by driving of the motor 8 and the rotation is transmitted to the driving shaft 18 by the belt 14 to rotate the cams 19*a* and 19*b*. If the cams 19*a* and 19*b* rotate, the cam followers 7*a* and 7*b* pushed against the peripheral faces of the cams 19*a* and 19*b* reciprocate on straight lines following the peripheral faces of the cams 19*a* and 19*b* and, as a result, the plungers 6*a* and 6*b* retained by the cam followers 7*a* and 7*b* slide in the pump chambers in the pump head 2 to take in and discharge the solution.

Figure 2A:
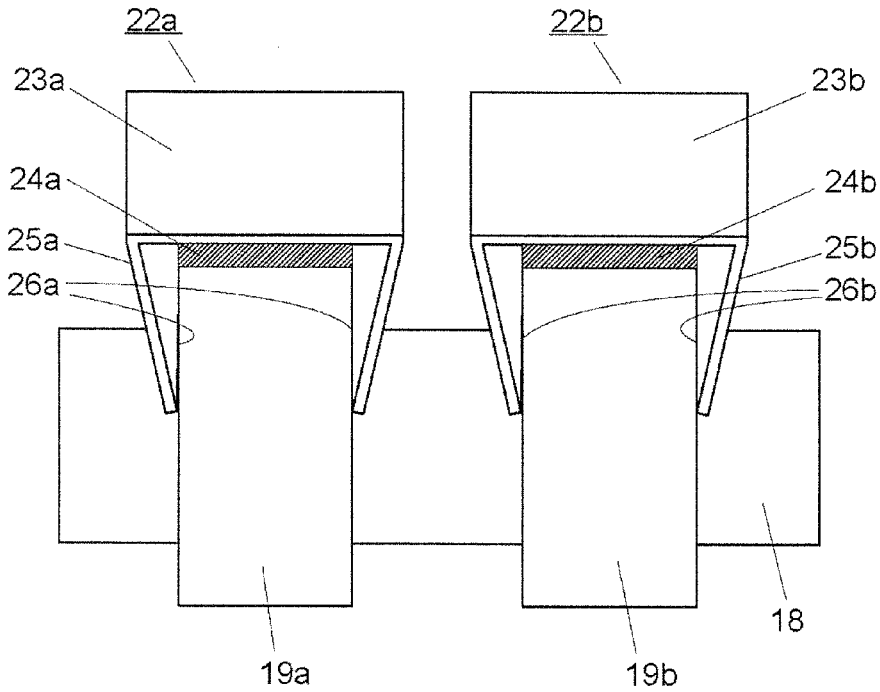
FIG. 2A is a front view of a cam mechanism in the embodiment and FIG. 2B is a side view of one of the cams from a direction of a section of a rotary shaft.
Figure 2B:
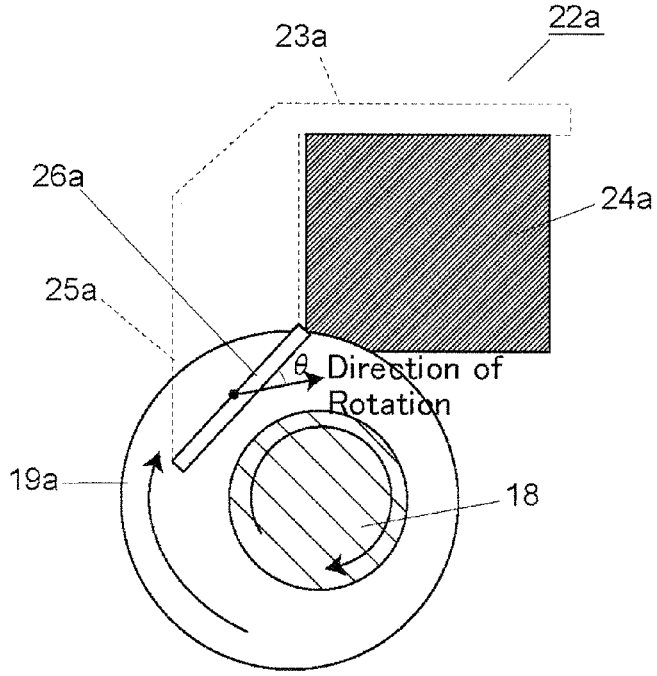

As shown in FIG. 2A, provided to upper portions of the cams 19*a* and 19*b* are lubricant supply mechanisms 22*a* and 22*b* for supplying lubricant for allowing the cam followers 7*a* and 7*b* to smoothly slide along the peripheral faces of the cams 19*a* and 19*b*. A structure of the lubricant supply mechanism 22*a* is shown in FIG. 2B.

The lubricant supply mechanism 22*a* includes a fixing member 23*a* and the fixing member 23*a* is fixed to a cover (not shown) covering the cam mechanism including, for example, the cam follower 7*a* and the cam 19*a*. The fixing member 23*a* retains a lubricant retaining member 24*a* made of sponge impregnated with the lubricant. The lubricant is, for example, metallic soap based grease. The lubricant retaining member 24*a* is in contact with the peripheral face of the cam 19*a*.

The fixing member 23*a* has a recovery blade 25*a*. Because lower end portions 26*a* of the recovery blade 25*a* are in contact with side face peripheral edge portions of the cam 19*a*, the recovery blade 25*a* serves as the lubricant recovery member. The recovery blade 25*a* is provided to cover the upper portion of the cam 19*a* from above the cam 19*a*, has a width which is greater than a width of the peripheral face of the cam 19*a* and is gradually decreasing, and has the lower end portions 26*a* in contact with opposite side faces of the cam 19*a*. Because the recovery blade 25*a* is inclined with respect to the side faces of the cam 19*a* and the lower end portions 26*a* are in contact with the side faces of the cam 19*a*, the lubricant flowing from the peripheral face to the side faces of the cam 19*a* is held back and recovered by the lower end portions 26*a*. Here, the inclination angle of the recovery blade 25*a* with respect to the side faces of the cam 19*a* is preferably about 5° to 85°.

Figure 3A:
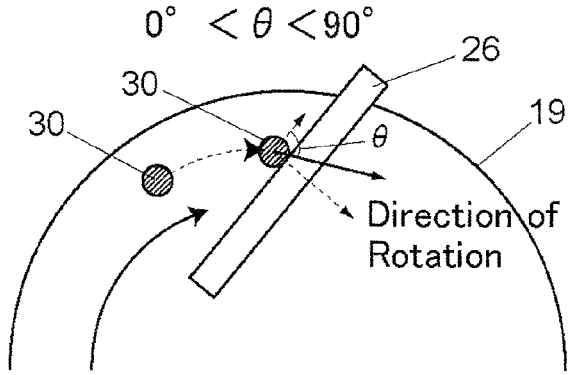
Figure 3B:
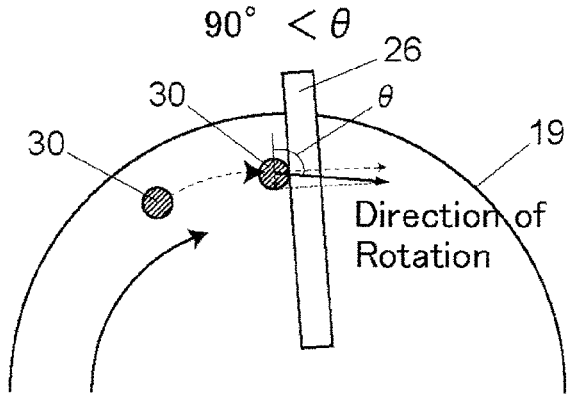

An angle θ that the lower end portions 26*a* of the recovery blade 25*a* make with the direction of rotation of the cam 19*a* is smaller than 90°. As a result, as described by using FIG. 3A, force applied to the lubricant held back by the lower end portions 26*a* due to rotation of the side faces of the cam 19*a* acts toward the peripheral face of the cam 19*a* along the lower end portions 26*a*, and therefore, the lubricant on the side faces of the cam 19*a* is guided to the peripheral face.

Because the other lubricant supply mechanism 22*b* has the same structure as the lubricant supply mechanism 22*a*, it will not be described here in detail.

As described above, because the recovery blades 25*a* and 25*b* for guiding the lubricant on the side faces of the cams 19*a* and 19*b* toward the peripheral face are provided, the lubricant that has flowed to the side faces of the cams 19*a* and 19*b* can be used efficiently and use efficiency of the lubricant is improved. Because the lubricant retaining members 24*a* and 24*b* of the lubricant supply mechanisms 22*a* and 22*b* can retain the lubricant guided to the peripheral faces by the recovery blades 25*a* and 25*b* again and apply the lubricant on the peripheral faces of the cams 19*a* and 19*b*, a rate of decrease of the lubricant in the lubricant retaining members 24*a* and 24*b* can be suppressed and consumption of the lubricant can be reduced.

Figure 4:
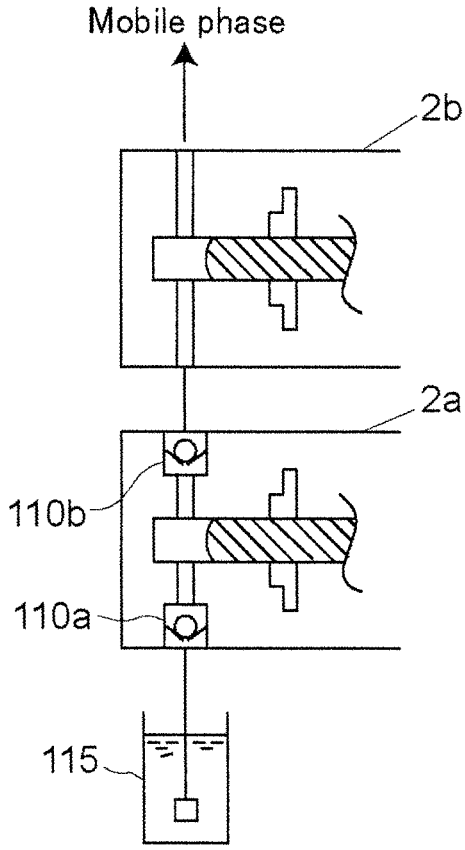
FIG. 4 is a schematic sectional view of pump heads when the present invention is applied to a double-plunger liquid sending pump.

FIG. 4 shows an example of the pump head 2 in FIG. 1. The pump head 2, for example, forms a pump for sending mobile phase to a column in high-speed liquid chromatograph. In this example, the two pump heads 2*a* and 2*b* are connected in series to form a double-plunger reciprocating liquid sending pump in order to suppress pulsation at the time of sending of the mobile phase. An intake side of the primary pump head 2*a* is connected to a mobile phase vessel 115 for storing the mobile phase with a check valve 110*a* interposed therebetween, and a discharge side is connected to an intake side of the secondary pump head 2*b* with a check valve 110*b* interposed therebetween. A discharge side of the secondary pump head 2*b* is connected to the column of the high-speed liquid chromatograph.

Figure 5:
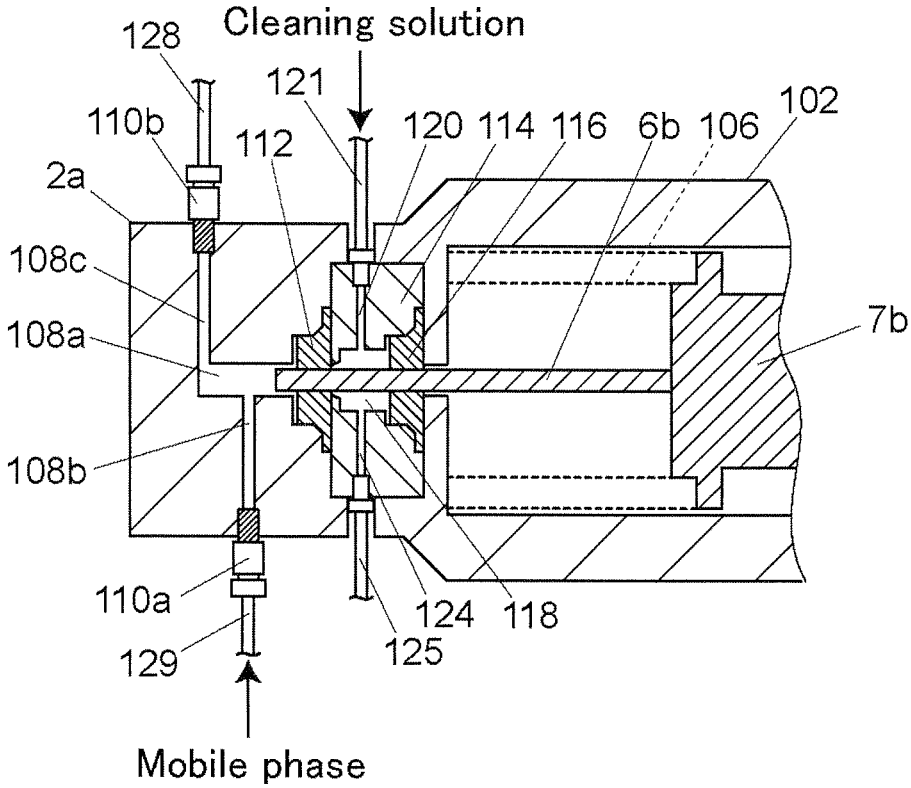
FIG. 5 is a sectional view of a primary pump head out of the pump heads in FIG. 4.

FIG. 5 shows a concrete example of the primary pump head 2*a*. A structure of the secondary pump head 2*b* is the same as that of the primary pump head 2*a* except that it is not provided with check valves, and therefore, the secondary pump head 2*b* is not shown.

The pump head 2*a* having, in itself, the pump chamber 108*a*, an intake flow path 108*b*, and a discharge flow path 108*c* is mounted to a tip end of a pump body 102. The pump head 2 in FIG. 1 includes the pump body 102. In the pump body 102, the cam follower 7*b* in contact with a base end portion of the plunger 6*b* is housed and biased by a spring 106 in a direction opposite from the pump head 2*a*. The plunger 6*b* is retained on a tip end side of the cam follower 7*b*, and the tip end of the plunger 6*b* is inserted into the pump chamber 108*a*.

The cam follower 7*b* is caused to reciprocate on a straight line (in a left-right direction in FIG. 5) by a driving mechanism (see FIG. 1) including the cam 19*b*, and, as a result, the plunger 6*b* also reciprocates on the straight line to increase and decrease a capacity in the pump chamber 108*a*. The intake flow path 108*b* is connected to a pipe 129, which is connected to the vessel for storing the mobile phase, with the check valve 110*a* interposed therebetween, and the discharge flow path 108*c* is connected to a pipe 128, which is connected to the secondary pump head 2*b*, with the check valve 110*b* interposed therebetween.

Between the tip end portion of the pump body 102 and the pump head 2*a*, a plunger seal 112, a seal holder 114, and a cleaning seal 116 are sandwiched in this order from the pump head 2*a* side. The plunger seal 112 is for sealing the pump chamber 108*a* while retaining the plunger 6*b* for sliding at a portion of the pump chamber 108*a* where the plunger 6*b* is inserted and the plunger seal 112 is supported by the seal holder 114.

The seal holder 114 has, in itself, a cleaning chamber 118 and cleaning chamber flow paths 120 and 124. A pipe 121 for supplying a cleaning solution is connected to the cleaning chamber flow path 120, and a pipe 125 for discharging the cleaning solution from the cleaning chamber 118 is connected to the cleaning chamber flow path 124. The cleaning chamber 118 is sealed with the cleaning seal 116.

The invention claimed is:

1. A cam mechanism comprising:

a cam having a peripheral face supplied with lubricant and a pair of parallel side faces sandwiching the peripheral face, the cam being driven for rotation;

a cam follower in contact with the peripheral face and following, displacement of the peripheral face due to the rotation of the cam; and a lubricant recovery member configured to direct lubricant on the side faces of the cam to the peripheral face, the lubricant recovery member being in contact with the pair of parallel side faces of the cam, having such a length as to reach at least cam side face peripheral edge portions, which are boundaries between the side faces and the peripheral face, and being disposed such that a line of contact between the lubricant recovery member and a side face of the cam is at an inclination angle smaller than 90° with respect to a direction of rotation of the cam.

2. The cam mechanism according to claim 1, further comprising a lubricant retaining member in contact with the peripheral face of the cam and for retaining the lubricant.

3. A liquid sending pump comprising:

a cam mechanism including:

a cam having a peripheral face supplied with lubricant and a pair of parallel side faces sandwiching the peripheral face, the cam being driven for rotation;

a cam follower in contact with the peripheral face and following displacement of the peripheral face due to the rotation of the cam; and a lubricant recovery member configured to direct lubricant on the side faces of the cam to the peripheral face, the lubricant recovery member being in contact with the pair of parallel side faces of the cam, having such a length as to reach at least cam site face peripheral edge portions, which are boundaries between the side faces and the peripheral face, and being disposed such that a line of contact between the lubricant recovery member and a side face of the cam is at an inclination angle smaller than 90° with respect to a direction of rotation of the cam;

a pump chamber; and a plunger having a base end portion in contact with the cam follower and a tip end portion inserted into the pump chamber and for reciprocating on a straight line as the cam rotates to increase and decrease a capacity of the pump chamber to thereby take and discharge solution into and out of the pump chamber.

4. The liquid sending pump according to claim 3, further comprising a lubricant retaining member in contact with the peripheral face of the cam and for retaining the lubricant.

* * * * *